United States Patent [19]

Hsieh et al.

[11] 4,338,690

[45] Jul. 13, 1982

[54] AUTOMATIC MECHANISM FOR FLUSH AND RAISING TOILET SEAT

[76] Inventors: Jung H. Hsieh; Jung K. Hsieh, both of 7, Alley 1, La. 225, Sec. 6, Chung Hsiao E. Rd., Taipei, Taiwan

[21] Appl. No.: 108,234

[22] Filed: Dec. 28, 1979

[30] Foreign Application Priority Data

Dec. 1, 1978 [TW] Taiwan ..... 6722913

[51] Int. Cl.[3] ..... A47K 13/10; E03D 5/04

[52] U.S. Cl. ..... 4/300; 4/250; 4/251; 4/302; 4/313; 4/408; 4/413

[58] Field of Search ..... 4/661, 300, 249, 250, 4/251, 313, DIG. 3, 330, 335, 338, 405, 411, 408, 414, 234, 236, 237, 302, 305, 409, 413, 473

[56] References Cited

U.S. PATENT DOCUMENTS

| | | | |
|---|---|---|---|
| 933,830 | 9/1909 | Davis | 4/408 |
| 989,496 | 4/1911 | Furlong | 4/408 |
| 1,044,209 | 11/1912 | Luna | 4/408 |
| 1,529,656 | 3/1925 | Kornhauser | 4/251 |
| 1,863,682 | 6/1932 | Alberts | 4/251 |
| 1,975,214 | 10/1934 | Schwibinger | 4/250 |
| 2,428,685 | 10/1947 | Shepard | 4/250 |
| 2,814,049 | 11/1957 | Mercuy | 4/251 |
| 3,056,142 | 10/1962 | Chin | 4/250 |
| 3,404,411 | 10/1968 | Newkirk | 4/251 |
| 3,781,924 | 1/1974 | Davis, Jr. | 4/251 |

*Primary Examiner*—Stuart S. Levy

*Attorney, Agent, or Firm*—Finnegan, Henderson, Farabow, Garrett & Dunner

[57] ABSTRACT

The present invention relates to an automatic mechanism for flush and raising a toilet seat which permits the seat to be raised automatically to a vertical, non-use position and the wash water to automatically flush the urinal after the occupancy of the toilet seat.

6 Claims, 3 Drawing Figures

AUTOMATIC MECHANISM FOR FLUSH AND RAISING TOILET SEAT

FIELD OF THE INVENTION

This invention provides an automatic mechanism for flush and raising a toilet seat comprising an actuating device secured to the back of a conventional bowl for raising the toilet seat automatically, and a construction for automatically controlling the discharging operation of the flush valve of the water tank thereof.

BACKGROUND OF THE INVENTION

Where a urinal is manually actuated, it has been observed that the urine left on the toilet seat always causes great inconvenience to the users, especially to ladies; and furthermore, the urinal flush valve is not always operated after the urinal is used either because of reluctance of the user to touch the operating handle of the flush valve, or because of an oversight on the part of the user. To overcome these problems, the toilets provided with separate devices for automatically raising the seat thereof and flushing the urinal after the user of the toilet rises from the seat have been well developed in this art.

However, these devices are disposed separately on the conventional toilet and therefore they are complicated in construction, undurable in use, expensive in manufacture and insufficient in operation when taken as a whole.

SUMMARY OF THE INVENTION

A main object of the present invention is to provide an automatic mechanism for raising a toilet seat and flushing the urinal in which the actuating device is positioned on the back of the toilet for urging the seat to a raised position after the user's rising from the seat.

A further object of the present invention is to provide a tongue device on the end plate of the toilet seat for engaging with two projections on the toilet, the first to hold the seat in a near horizontal position, and the second to allow the seat to rise automatically to a vertical position when occupation of the seat is terminated.

A still further object of the present invention is to provide a one-way gear on the shaft of the toilet seat for moving downwardly the rack thereof to open the flush valve of the water tank with the aid of a set of levers situated on the water tank when the toilet seat is raised to a vertical position.

Another still further object of the present invention is to provide two springs for enabling the rack to rise after completion of the flushing operation so that the flush valve of the water tank may be closed.

These and other objects and advantages of the present invention will be readily apparent with reference to the following description and annexed drawings, in which.

DETAILED DESCRIPTION OF THE PREFERRED EMBODIMENT

Figure 2:
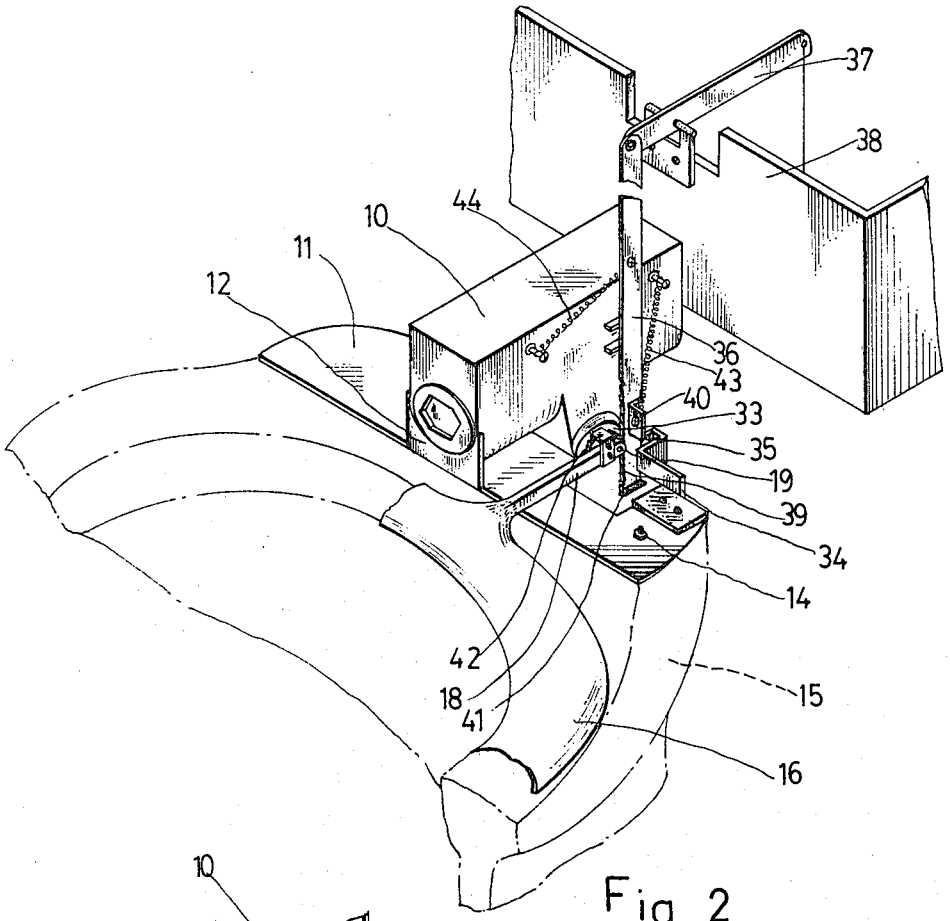
FIG. 2 is a perspective right-side view of the automatic mechanism of FIG. 1.
Figure 1:
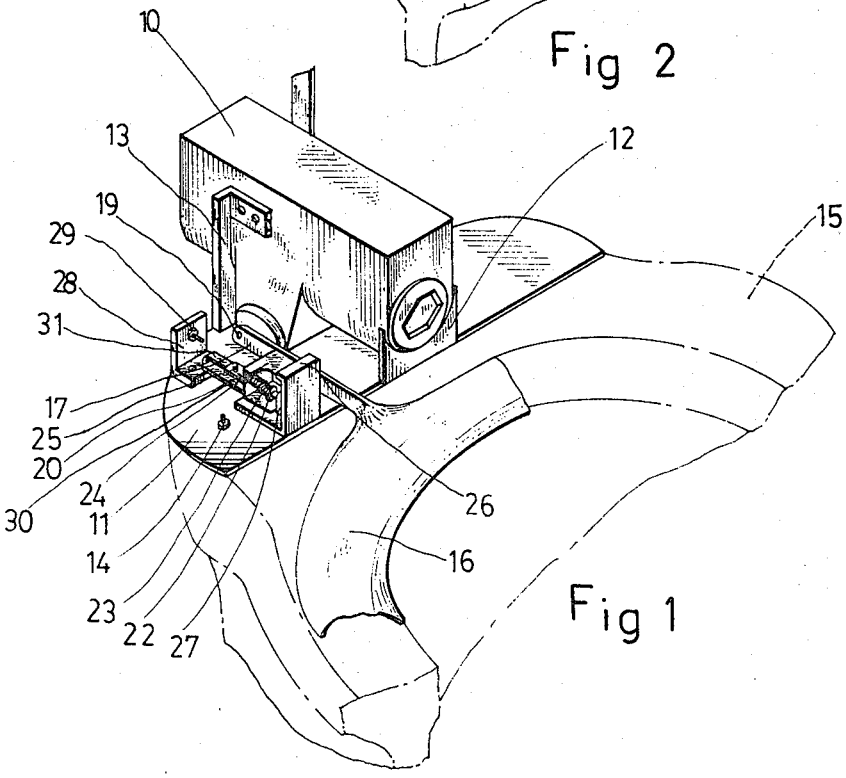
FIG. 1 is a perspective left-side view of an automatic mechanism for flush and raising a toilet seat in accordance with the present invention.

FIGS. 1, 2 are perspective left and right side views of an automatic mechanism for toilet flusher and toilet seat in accordance with the present invention. The automatic mechanism as shown is provided with an actuating device 10 secured to the back of a conventional toilet bowl 15 and supported by two brackets 12, 13 on a base plate 11 which is screwed to the bowl 15 by a bolt 14. A seat 16 has end plate means which includes two end plates 27, 28 swingably hinged to the actuating device 10 by means of a shaft 19. The actuating device can be a torsion spring, a hydraulic mechanism, or the like. As the actuating device 10 does not fall within the scope of this invention, it is not specifically identified in the embodiment herewith illustrated but it is contemplated that any device which is capable of urging the seat 16 to rise from a horizontal, operative position to an inoperative, upstanding position may be used with the present invention.

Figure 3:
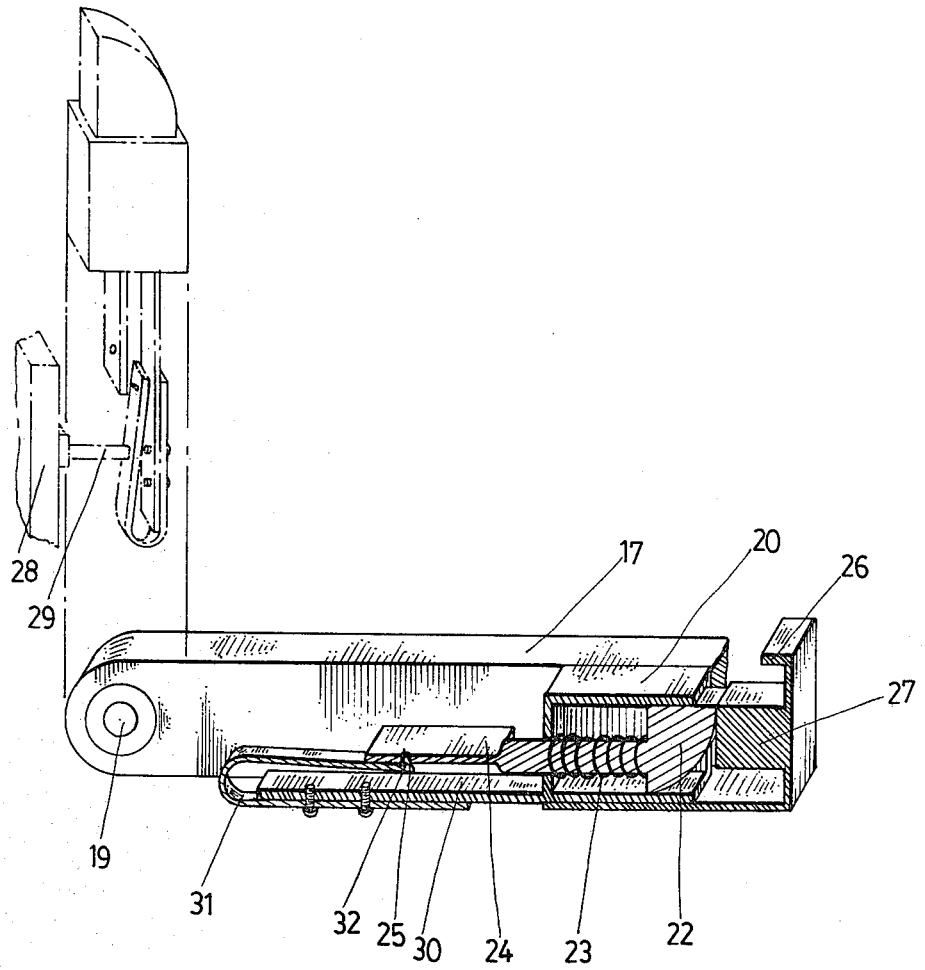
FIG. 3 is a side view showing the operating of the automatic mechanism of FIG. 1.

Referring to FIGS. 1 and 3 in greater detail, the partial structure of the automatic mechanism for moving the seat 16 to a raised position is herewith first described. The device comprises a tongue housing 20 disposed on the end plate 17 and within the tongue housing 20 is provided with a tongue 22 which is biased by a spring 23 in a direction outwardly of the housing 20 or toward the right as seen in FIG. 3. The other end 24 of the tongue 22 extends beyond the housing 20 and has a hole 25 therein. First and second projections 26, 27 are provided on the base plate 11, the second projection 27 being longer than the first projection 26. A support 28 is provided with a stopping pin 29 and is secured to the back of base plate 11. A plate 30 extends rearwardly from the housing 20 and has a spring leaf 31 fixed thereto. A pin 32 is provided on one end of the spring leaf.

The movement of the seat 16 will be fully described with reference to FIG. 3. When the seat 16 is kept in an inoperative, vertical position, the tongue 22 extends out of the housing 20 because of the biasing force of spring 23 and the pin 32 on the spring leaf 31 is maintained separated from the hole 25 on the end portion 24 of the tongue 22. When the seat 16 is first moved downwardly by the user, the forward surface of tongue 22 comes into contact with the first projection 26 causing the tongue to move inwardly of the housing until the top surface of the tongue engages beneath the projection 26. This holds the seat 26 in a near horizontal position. When the user sits on the seat 16, the tongue 22 comes into contact with the second projection 27 and is moved further into the housing 20 and the pin 32 enters the hole 25. The spring force on the leaf 31 presses the pin 32 toward the hole 25. After termination of the occupancy, the seat 16 is automatically actuated by the device 10 to move to a raised position and the pin 32 prevents the tongue from reengaging the projection 26. When the seat 16 is fully upright, the stopping pin 29 presses against the spring leaf 31 to release the pin 32 from the hole 25 and the tongue moves to extend through the housing 20 as shown in dot-dash lines in FIG. 3.

For detailed description of the automatic flusher device please refer again to FIG. 2. The device comprises a one-way gear 33 positioned on the shaft 19 of the seat 16, a stopping member 34 located on the base plate 11 with an empty space 35 on its back, a rack 36 extending upwardly from said empty space 35 for controlling the flush valve of a water tank 38 by means of a lever 37 and for meshing with said one-way gear 33 with its teeth 39 thereon, two stoppers 40 and 41 disposed on the rack 36, a pushing means 42 situated on the end plate 18 of the seat and two springs 43, 44 as shown thereon for controlling the rack 36. When the seat 16 is raised from the toilet bowl 15 after being used, the gear 33 keeps meshing with the teeth 39 of the rack 36 with the aid of the spring 44. As a result of the mesh, the downward movement of the rack 36 will open through the arm lever 37 the flusher valve of the water tank 38 for flushing. Following the rising of the seat 16 to a certain position the pushing means 42 on the plate 18 starts coming into contact with the stopper 40 on the rack 36 to cause the teeth 39 of the rack 36 to depart from the one-way gear 33, and the recovering force of the spring 43 will enable the rack 33 to rise to its original position until the stopper 41 meets with the stopping member 34. At the time the seat 16 is lowered again, although the teeth 39 of the rack 36 is in contact with the gear 33, the gear keeps idle running or free wheeling without exerting influence on the downward movement of the seat 16. As such, the flushing operation of the toilet is completed.

While a single embodiment of the invention has been illustrated and described, other embodiments are contemplated and many changes and modifications of the mechanism may be made and practiced without departing from the spirit and scope of the present invention as more particularly set forth in the appended claims.

What is claimed is:

1. An automatic mechanism for flushing a toilet and controlling the positioning of a toilet seat, comprising:

a toilet seat having end plate means pivoted at the back of a toilet bowl;

an actuating device on the back of said toilet bowl and normally biasing said seat toward a vertical position;

means for controlling movement of said toilet seat including means operable to hold said seat in a near horizontal position and to release said holding means when said seat is occupied by a user and moved downwardly from said near horizontal position so that said seat will be raised to a vertical position by said actuating device after termination of occupancy;

means for automatically flushing said toilet including means operable in response to movement of said seat from a horizontal to a vertical position.

2. A mechanism as claimed in claim 1, said movement controlling means including cooperable means on said end plate means and toilet bowl.

3. A mechanism as claimed in claim 1, said movement controlling means including means on the back of said toilet bowl forming first and second projections, a housing on said end plate means, a tongue carried by said housing and normally biased in a first direction, said tongue being operable to cooperatively engage with said first projection to hold said seat in a nearly horizontal position and engaging with said second projection when a user occupies said seat to move said tongue in a second direction, and releasable means for preventing return movement of said tongue in said first direction until said seat is returned to a vertical position.

4. A mechanism as claimed in claim 3, said releasable means including a hole in said tongue and a spring biased pin on said housing adapted to enter said hole when said tongue is moved in said second direction upon engagement with said second projection.

5. A mechanism as claimed in claim 4, including means operable to withdraw said spring biased pin from said hole upon movement of said seat to a vertical position.

6. A mechanism as claimed in claim 1, said automatic flushing means including a rack disposed adjacent the back of the toilet bowl and operatively connected to a flush mechanism, a one-way gear connected to said end plate and meshing with said rack and operable to move said rack in one direction when said seat is raised, and to free wheel or idle when said seat is lowered, means normally biasing said rack into engagement with said gear and in another direction opposite said one direction, and means on said end plate means operable to engage said rack and move it away from said gear when said seat is raised to its vertical position.

* * * * *